US007252443B2

(12) United States Patent
Huang

(10) Patent No.: US 7,252,443 B2
(45) Date of Patent: Aug. 7, 2007

(54) PRINTER CAPABLE OF DETECTING STATUS OF UNUTILIZED RIBBON

(75) Inventor: Kuang-Huei Huang, Taipei (TW)

(73) Assignee: Hi-Touch Imaging Technologies Co., Ltd., Pan-Chiao, Taipei Hsien (TW)

( * ) Notice: Subject to any disclaimer, the term of this patent is extended or adjusted under 35 U.S.C. 154(b) by 374 days.

(21) Appl. No.: 10/906,805

(22) Filed: Mar. 8, 2005

(65) Prior Publication Data

US 2006/0110201 A1 May 25, 2006

(30) Foreign Application Priority Data

Nov. 23, 2004 (TW) ..... 93136042 A

(51) Int. Cl.
*B41J 33/32* (2006.01)
*B41J 33/36* (2006.01)
*B41J 35/35* (2006.01)

(52) U.S. Cl. ..... 400/249; 400/237; 400/429

(58) Field of Classification Search ..... 400/429, 400/237, 249

See application file for complete search history.

(56) References Cited

U.S. PATENT DOCUMENTS 4,685,818 A * 8/1987 Kazarian et al. ..... 400/249
5,562,351 A * 10/1996 Uematsu ..... 400/68

FOREIGN PATENT DOCUMENTS

| | | |
|---|---|---|
| JP | 55011805 | * 1/1980 |
| JP | 63168379 | * 7/1988 |
| JP | 01272480 | * 10/1989 |
| JP | 08324085 | * 12/1996 |
| JP | 2002052794 | * 2/2002 |

* cited by examiner

*Primary Examiner*—Daniel J. Colilla
*Assistant Examiner*—Marissa Ferguson-Samreth
(74) *Attorney, Agent, or Firm*—Winston Hsu

(57) ABSTRACT

A printer includes a ribbon supply end including a shaft, a ribbon retrieving end, and a ribbon. The two ends of the ribbon are installed on the ribbon supply end and the ribbon retrieving end respectively. The printer further includes a print head, a driving module for driving the ribbon supply end and the ribbon retrieving end so as to move the ribbon from the ribbon supply end to the ribbon retrieving end, a sensing module installed at one side of the ribbon supply end including a first contact sensor, and a second contact sensor installed between the first contact sensor and the ribbon supply end, and a control module for controlling the printer according to whether or not the second contact sensor can contact the shaft of the ribbon supply end when the first contact sensor contacts the ribbon on the ribbon supply end.

26 Claims, 8 Drawing Sheets

PRINTER CAPABLE OF DETECTING STATUS OF UNUTILIZED RIBBON

BACKGROUND OF INVENTION

1. Field of the Invention

The present invention relates to a printer capable of detecting status of unutilized ribbon, more particularly, to a printer capable of utilizing a contact sensor to detect the status of unutilized ribbon.

2. Description of the Prior Art

A printer has become an essential output device in our information age. A traditional printer prints data onto a piece of paper or a print medium. As information technology advances, printers nowadays come with a variety of functions. For example, a thermal printer is capable of printing an image directly from a digital camera onto a piece of paper, the advantage is that a user can choose to print a favorite image or photograph and discards the rest. Therefore avoiding waste of resources and money to develop a full roll of traditional negatives to print photographs. The current thermal printer, utilizes a thermal print head to print documents, includes a paper drawer for placing print material such as paper, and an imaging material cassette for placing imaging material such as ink film or ribbon.

The thermal printer and ink jet printer have very similar frameworks, the only difference being that the ink jet printer requires liquid ink whereas the thermal printer utilizes a solid ribbon. Most ink jet printers utilize a half tone printing method; they are unable to print continuous tone of a real life photograph. Hence, the thermal printer that has a continuous tone function is becoming more popular among consumers. The thermal printer utilizes a sublimation technique to apply colors of the transfer ribbon directly onto the paper; the ribbon is a transparent cellular paper that includes dye. During the process of printing, the thermal print head heats up the ribbon's dye. The melted color will be transferred from the ribbon onto the paper. Later when the color on the paper cools a colored image will be displayed.

In general, to ensure that there is sufficient ribbon for the next printout, there is a need to detect if the ribbon is reaching its end. In determining a conventional group of ribbon, a special barcode is added to the ribbon for the optical sensor to differentiate. Please refer to FIG. 1. FIG. 1 illustrates a perspective view of a ribbon apparatus of a conventional color printer 10. As shown in FIG. 1, the ribbon apparatus of the color printer 10 comprises a ribbon 12, two light sources 14, 16, and two sensors 18, 20. The ribbon 12 comprises a plurality of sequentially arranged dye regions 22. Each dye region 22 comprises four different color dye areas 24, 26, 28, 30 for placing yellow dye, magenta dye, cyan dye, and overcoating dye. An opaque dividing section 32 is located before a yellow dye area 24. A semi-opaque dividing section 34 and a transparent dividing section 36 are located between the dye areas 24 and 26, 26 and 28, 28 and 30. The light sources 14, 16 are located on one side of the ribbon 12 and produce light beams 38, 40 of two predetermined colors. The sensors 18, 20, corresponding to the light sources 14, 16, are located on the opposite side of the ribbon 12. The sensors 18, 20 are utilized to detect light beams 38, 40 penetrating through the ribbon 12 and produce corresponding signals to determine the position of the ribbon 12. The detection of an opaque dividing section 32 signals the beginning position of a new dye region 22 of the ribbon 12, and also corresponds to the beginning position of a yellow dye area 24. The detection of a semi-opaque dividing section 34 and a transparent dividing section 36 by the sensors 18, 20 corresponds to the beginning position of the magenta dye area 26, cyan dye area 28, or overcoating dye area 30. In the above-mentioned, a special barcode is added to the opaque dividing section 32 before a group of dye area 22 on the ribbon 12. The detection of the special barcode signals a last unused dye area 22 and to remind the user to replace the existing ribbon 12. In this method of detecting ribbon, the special barcode is needed to place in between each dye area, and it decreases the effective utilization of the ribbon 12, resulting in higher production costs of the ribbon 12.

SUMMARY OF INVENTION

The claimed invention relates to a printer capable of utilizing a contact sensor to detect status of unutilized ribbon and to solve the problem mentioned above.

One embodiment of the claimed invention is a printer capable of detecting the status of unutilized ribbon, the printer comprising: a ribbon supply end comprising a shaft; a ribbon retrieving end; a ribbon wherein two ends are installed on the ribbon supply end and the ribbon retrieving end respectively; a print head for printing dye on the ribbon onto a print medium; a driving module for driving the ribbon supply end and the ribbon retrieving end, and to move the ribbon from the ribbon supply end to the ribbon retrieving end; a sensor module installed at each side of the ribbon supply end comprising a first contact sensor, and a second contact sensor installed between the first contact sensor and the ribbon supply end; and a control module for controlling the printer when the first contact sensor contacts the ribbon on the ribbon supply end according to whether the second contact sensor can contact the shaft of the ribbon supply end.

One embodiment of the claimed invention is a method of controlling a printer, the method comprising the following steps: providing a first contact sensor, and a second contact sensor installed between the first contact sensor and a ribbon supply end of the printer; controlling the first contact sensor and the second contact sensor to move towards the ribbon supply end before the printer prints dye on a ribbon onto a print medium; and controlling the printer when the first contact sensor contacts the ribbon on the ribbon supply end according to whether the second contact sensor contacts a shaft of the ribbon supply end.

Another embodiment of the claimed invention is a printer capable of detecting the status of unutilized ribbon, the printer comprising: a ribbon supply end; a ribbon retrieving end comprising a shaft; a ribbon wherein two ends are installed on the ribbon supply end and the ribbon retrieving end respectively; a print head for printing dye on the ribbon onto a print medium; a driving module for driving the ribbon supply end and the ribbon retrieving end, and to move the ribbon from the ribbon supply end to the ribbon retrieving end; a sensor module, installed at each side of the ribbon retrieving end, comprising a first contact sensor, and a second contact sensor installed between the first contact sensor and the ribbon retrieving end; and a control module for controlling the printer when the first contact sensor contacts the ribbon on the ribbon retrieving end according to whether the second contact sensor can contact the shaft of the ribbon retrieving end.

Another embodiment of the claimed invention is a method of controlling a printer, the method comprising the following steps: providing a first contact sensor, and a second contact sensor installed between the first contact sensor and a ribbon retrieving end of the printer; controlling the first contact sensor and the second contact sensor to move towards the ribbon retrieving end before the printer prints dye on a ribbon onto a print medium; and controlling the printer when the second contact sensor contacts the shaft of the ribbon retrieving end according to whether the first contact sensor contacts the ribbon on the ribbon retrieving end.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
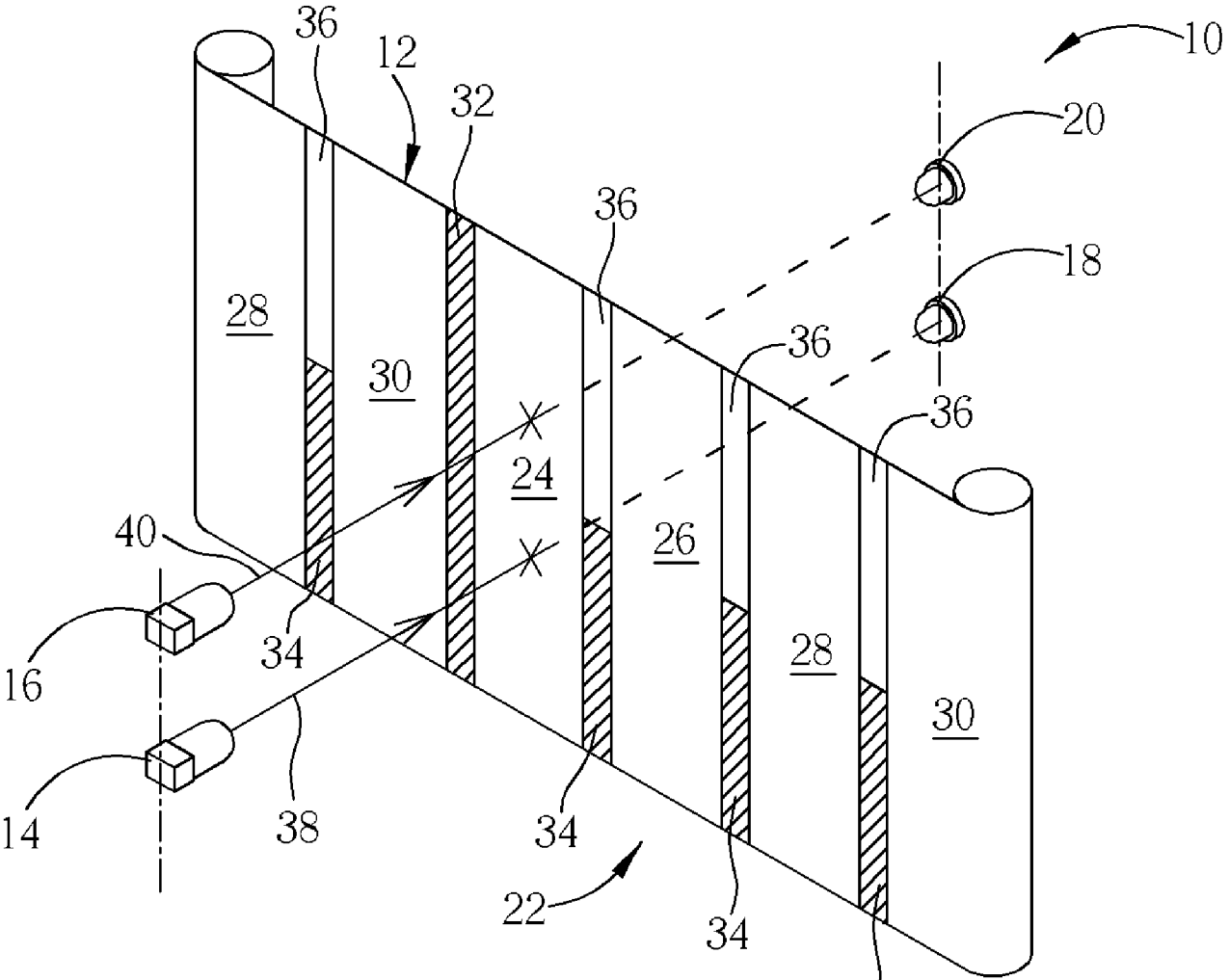
Fig. 1 Prior Art
FIG. 1 is a perspective view of a ribbon apparatus of a conventional color printer.
Figure 2:
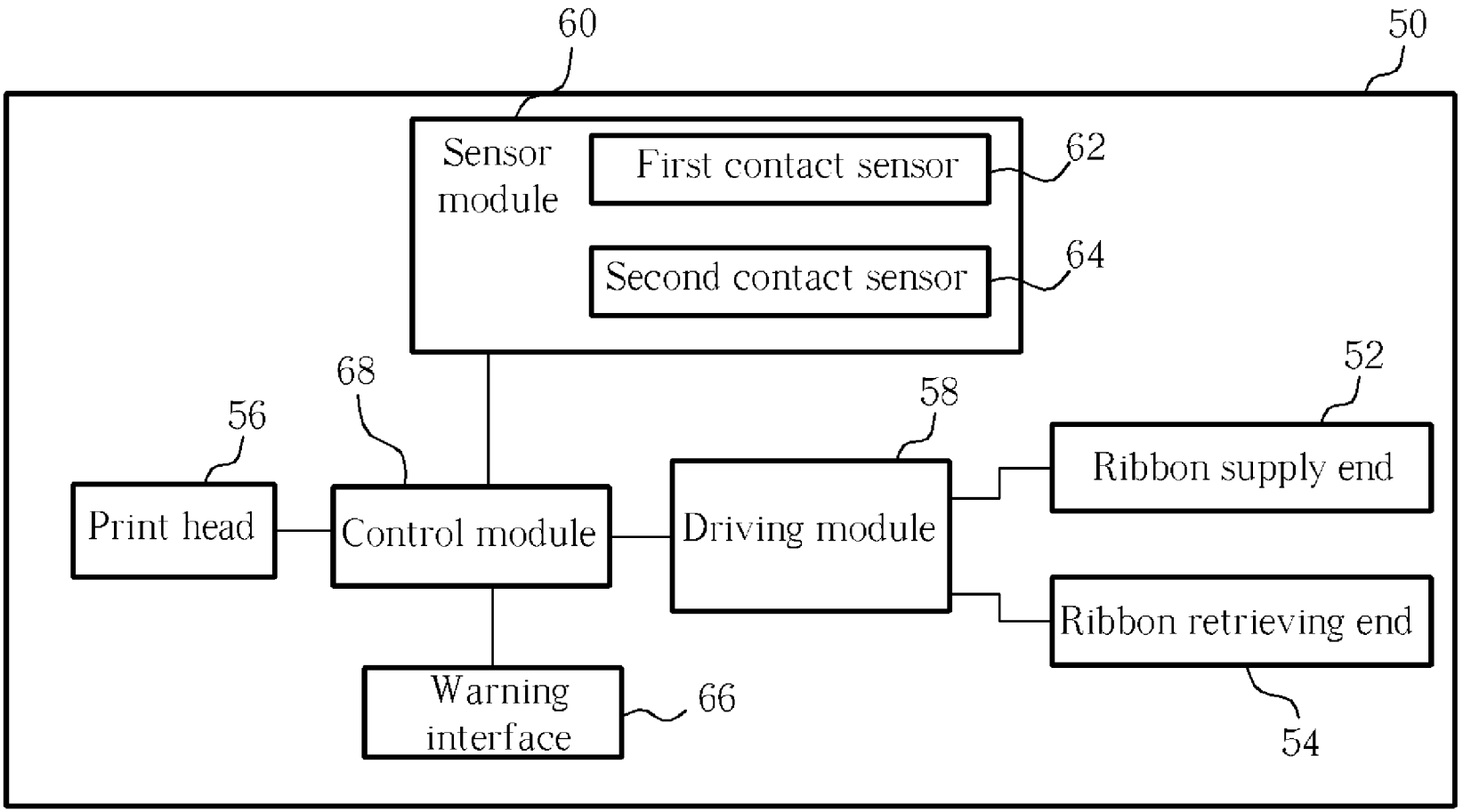
FIG. 2 illustrates a functional diagram of a printer capable of detecting unutilized ribbon according to the first embodiment of the present invention.

Please refer to FIG. 2. FIG. 2 illustrates a functional diagram of a printer 50 capable of detecting unutilized ribbon according to the first embodiment of the present invention. The printer 50 can be a thermal printer. The printer 50 comprises a ribbon supply end 52 which can be a roller, a ribbon retrieving end 54 which can also be a roller, a ribbon wherein two ends are installed on the ribbon supply end 52 and the ribbon retrieving end 54 respectively, a print head 56 for printing dye on the ribbon onto a print medium; a driving module 58 for driving the ribbon supply end 52 and the ribbon retrieving end 54, and to move the ribbon from the ribbon supply end 52 to the ribbon retrieving end 54; a sensor module 60 installed at each side of the ribbon supply end 52 comprising a first contact sensor 62, and a second contact sensor 64 installed between the first contact sensor 62 and the ribbon supply end 52; a warning interface 66 for displaying a warning signal which can be a warning light or a beeper, and a control module 68 for controlling the printer 50 when the first contact sensor 62 contacts the ribbon on the ribbon supply end 52 according to whether the second contact sensor 64 can contact the shaft of the ribbon supply end and also the control module 68 controls the warning interface 66 to display a warning signal when the first contact sensor 62 contacts the ribbon on the ribbon supply end 52 and the second contact sensor 64 contacts the shaft of the ribbon supply end 52.

Figure 3:
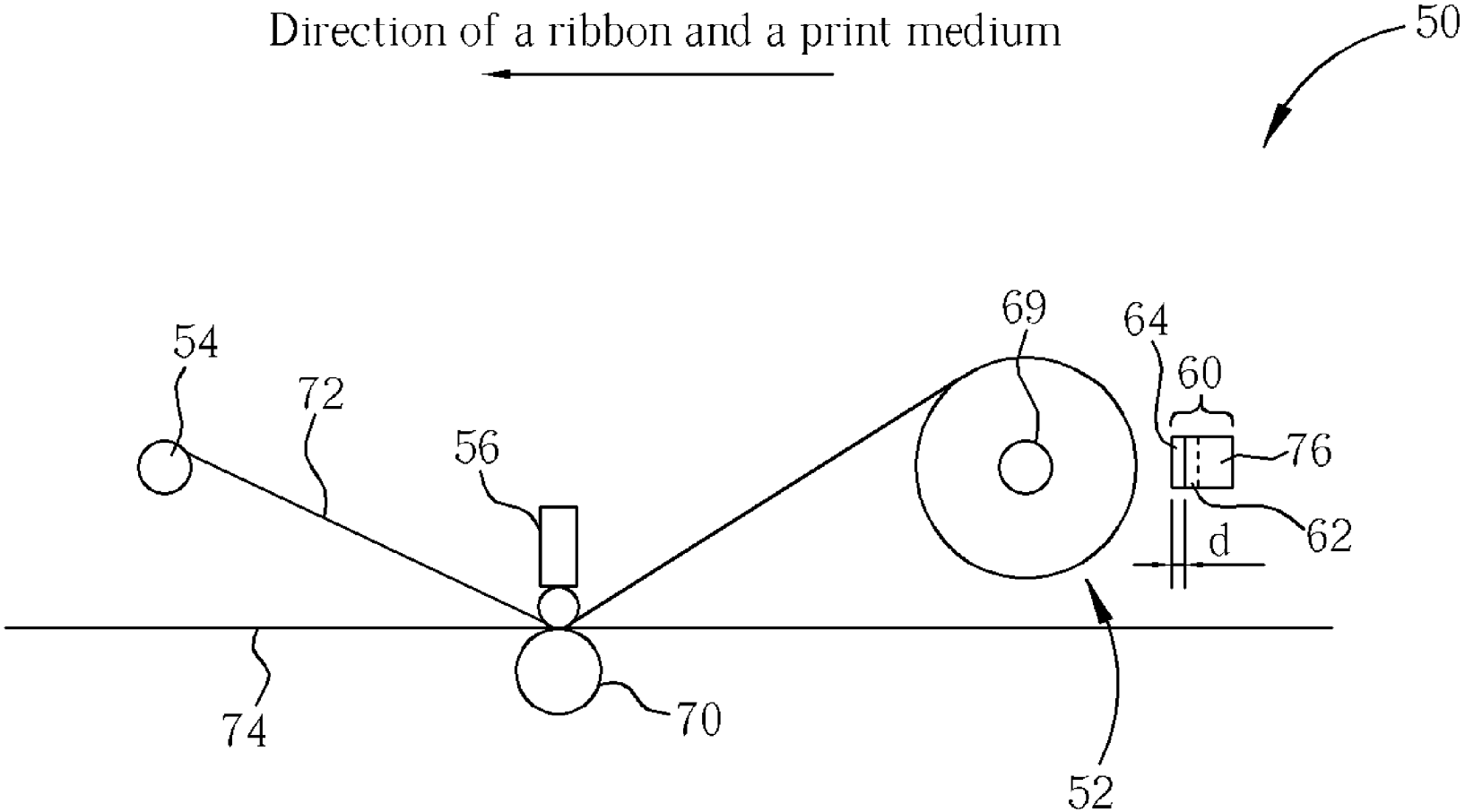
FIG. 3 is an internal architecture lateral diagram of a printer according to the first embodiment of the present invention.

Please refer to FIG. 3. FIG. 3 is an internal architecture lateral diagram of the printer 50 according to the first embodiment of the present invention. The ribbon supply end 52 comprises a shaft 69 wherein the unutilized ribbon is attached to the shaft 69 of the ribbon supply end 52. The printer 50 further comprises a platen roller 70 for clamping onto a ribbon 72 and a print medium 74 before executing a print out. The ribbon 72 and the print medium 74 move according to the direction pointed in the diagram. The ribbon 72 is capable of moving from the ribbon supply end 52 to the ribbon retrieving end 54, the ribbon on the shaft 69 of the ribbon supply end 52 will become less and the ribbon on the ribbon retrieving end 54 will become more which means that thickness of the ribbon on the shaft 69 of the ribbon supply end 52 will become thinner and the thickness of the ribbon on the ribbon retrieving end 54 will become thicker. A sensor module 60, installed at each side of the ribbon supply end 52. The sensor module 60 comprises a movable rod 76 for carrying a first contact sensor 62 and a second contact sensor 64, with the second contact sensor 64 installed in a location on the movable rod 76 which is close to the ribbon supply end 52. A distance d of an end of the first contact sensor 62 close to the ribbon supply end 52, and the distance d of an end of the second contact sensor close to the ribbon supply end 52 can be set by the designer. For example, the distance d can be set to be a distance from a ribbon on the shaft 69 contacting a group of unutilized ribbon dye area on the ribbon supply end 52 to an outer layer of the shaft 69 of the ribbon supply end 52, or a ribbon on the shaft 69 contacting a predetermined groups of unutilized ribbon dye areas to the outer layer of the shaft 69 of the ribbon supply end 52.

Figure 4:
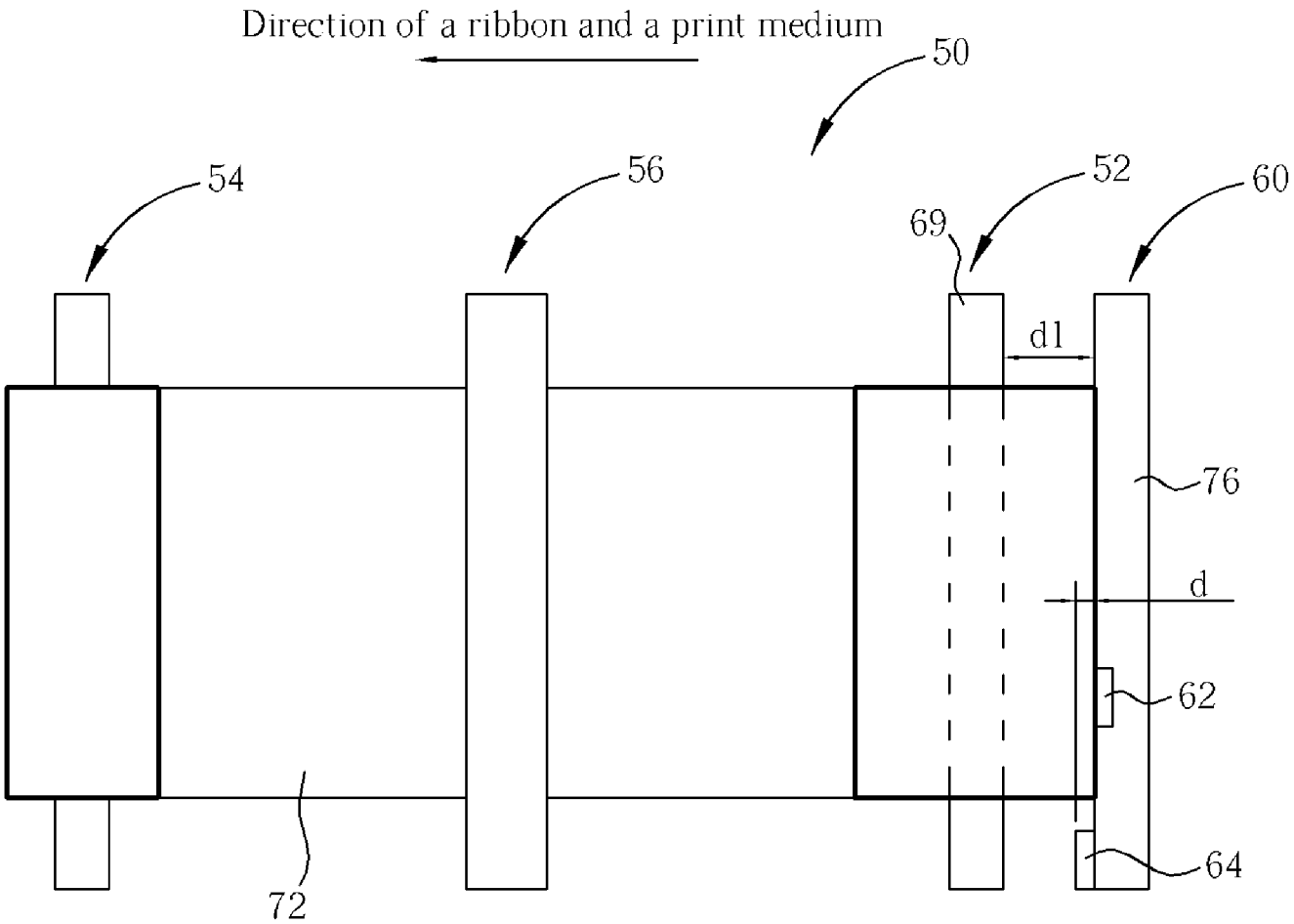
FIG. 4 illustrates an internal architecture top view diagram of a printer with sufficient ribbon according to the first embodiment of the present invention.

Please refer to FIG. 4. FIG. 4 illustrates an internal architecture top view diagram of a printer 50 with sufficient ribbon according to the first embodiment of the present invention. When executing each printout, before the print head 56 prints the dye on the ribbon 72 onto the print medium 74, the platen roller 70 and the print head 56 clamp onto the ribbon 72 and the print medium 74 together to prevent the ribbon 72 and the print medium 74 from slipping. Furthermore, the moving rod 76 of the sensor module 60 will carry the first contact sensor 62 and the second contact sensor 64 to move towards the ribbon supply end 52, when the first contact sensor 62 contacts the ribbon on the ribbon supply end 52, the sensor module 60 will transmit a corresponding signal to the control module 68 such that the control module is notified when the first contact sensor 62 has contacted the ribbon on the ribbon supply end 52. If the printer 50 has sufficient ribbon to execute a printout, which means that a distance d1 from the ribbon on the shaft 69 of the ribbon supply end 52 to the outer layer of the shaft 69 of the ribbon supply end 52 is greater than d, therefore the printer 50 has sufficient ribbon to perform a next printout. At the same time when the first contact sensor 62 contacts the ribbon on the ribbon supply end 52, as the distance d1 from the ribbon on the shaft 69 of the ribbon supply end 52 to the outer layer of the shaft 69 of the ribbon supply end 52 is greater than a distance d of an end of the first contact sensor 62 close to the ribbon supply end 52 and a distance d of an end of the second contact sensor 64 close to the ribbon supply end 52. The second contact sensor 64 cannot contact the shaft 69 of the ribbon supply end 52, which means that the unutilized ribbon in the printer 50 is sufficient to perform a next printout. Furthermore, the control module 68 will control the moving rod 76 to move away from the ribbon supply end 52, and control the driving module 58 to drive the ribbon supply end 52 and the ribbon retrieving end 54 and to move the ribbon from the ribbon supply end 52 to the ribbon retrieving end 54, and the control module 68 will control the print head 56 to print the dye on the ribbon onto the print medium 74, hence a printout is completed.

Figure 5:
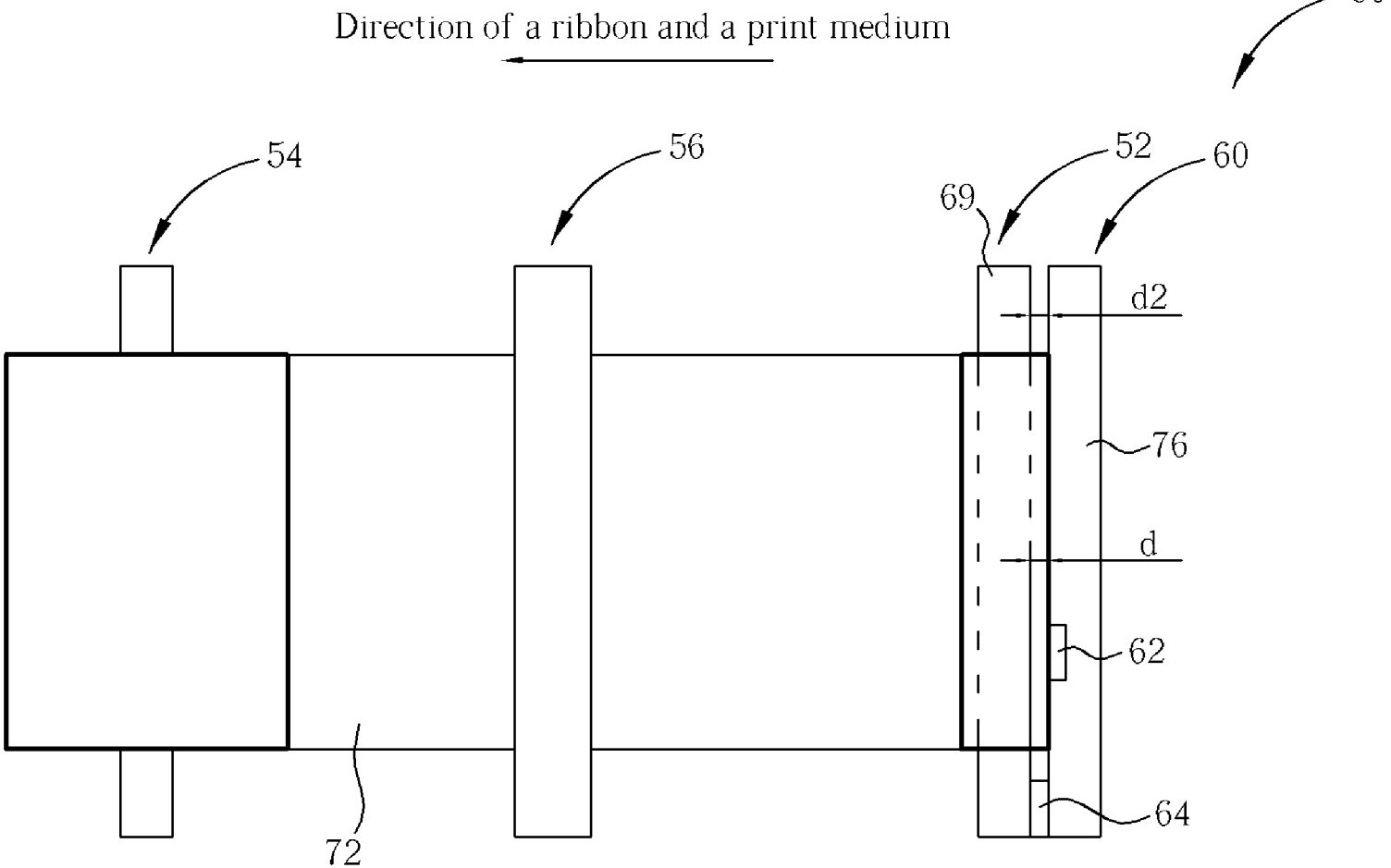
FIG. 5 illustrates an internal architecture top view diagram of a printer with insufficient ribbon according to the first embodiment of the present invention.

Please refer to FIG. 5. FIG. 5 illustrates an internal architecture top view diagram of a printer 50 with insufficient ribbon according to the first embodiment of the present invention. When the printer 50 cannot perform a next printout, which means that a distance d2 from the ribbon on the shaft 69 of the ribbon supply end 52 to the outer layer of the shaft 69 of the ribbon supply end 52 is lesser than the distance d, the printer 50 has insufficient unutilized ribbon for a next printout which means that the printer 50 cannot execute a next printout. The moving rod 76 of the sensor module 60 carries the first contact sensor 62 and the second contact sensor 64 towards the ribbon supply end 52. At the same time when the first contact sensor 62 contacts the ribbon on the ribbon supply end 52, as the distance d2 from the ribbon on the shaft 69 of the ribbon supply end 52 to the outer layer of the shaft 69 of the ribbon supply end 52 is lesser than a distance d of an end of the first contact sensor 62 close to the ribbon supply end 52 and a distance d of an end of the second contact sensor 64 close to the ribbon supply end 52. The second contact sensor 64 will contact the shaft 69 of the ribbon supply end 52, which means that the unutilized ribbon in the printer 50 is insufficient to perform a next printout. The sensor module 60 will transmit a corresponding signal to the control module 68, and in receiving the corresponding signal the control module 68 will not control the driving module 58 to drive the ribbon supply end 52 and the ribbon retrieving end 54, and will not control the print head 56 to print the dye on the ribbon onto the print medium 74, hence a print job is discontinued. Furthermore, after receiving the corresponding signal, the control module 68 is capable of controlling the warning interface 66 to display a warning signal to advice the user that there is insufficient ribbon to proceed with the next printout and to replace the existing ribbon. In this way, the printer 50 will not perform a next printout when there is insufficient ribbon therefore a printing error can be avoided.

Figure 6:
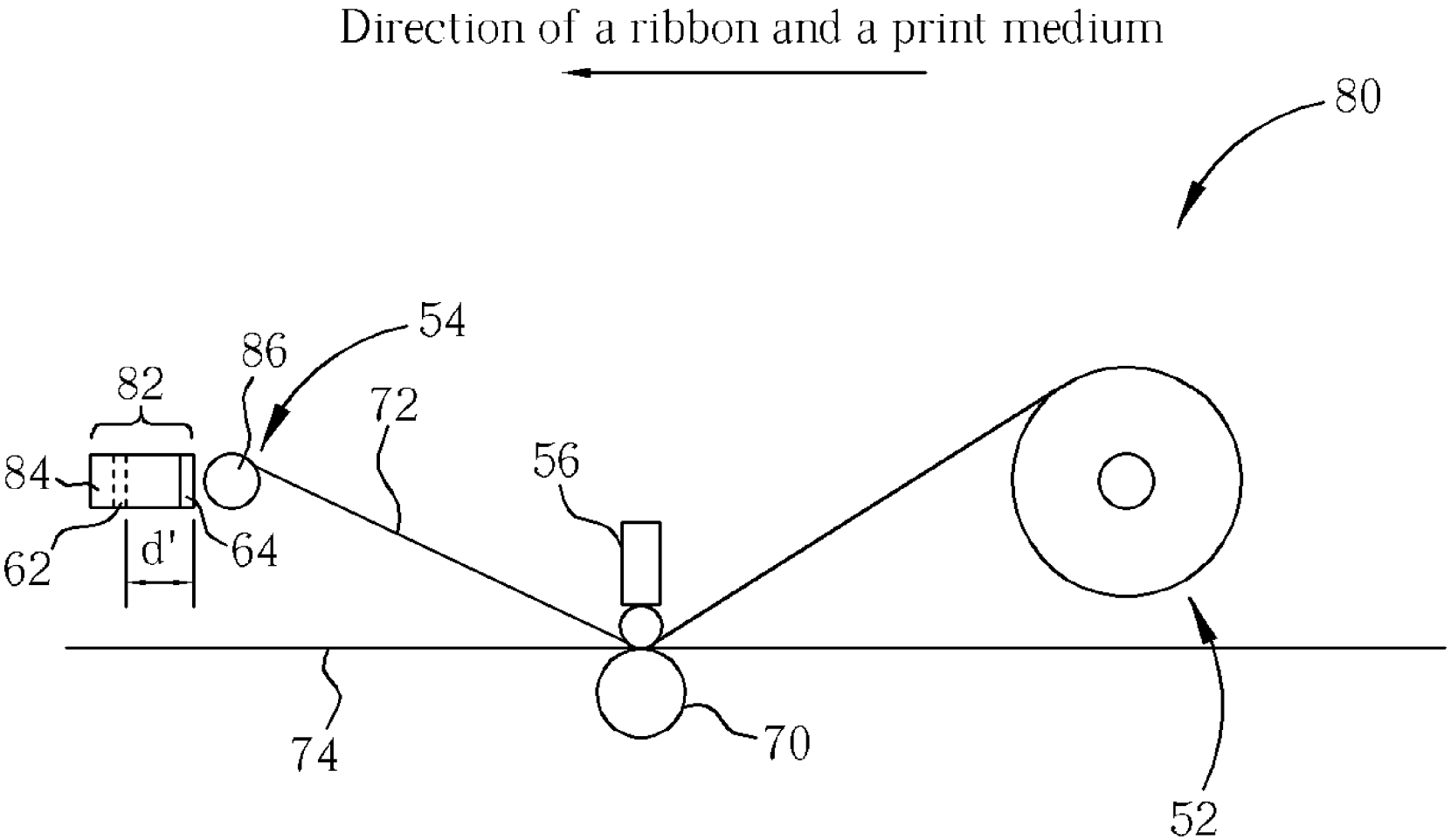
FIG. 6 illustrates an internal architecture lateral diagram of the printer according to a second embodiment of the present invention.

The sensor module 60 of the present invention is installed at each side of the ribbon supply end. The label, functions and location will be similar to the above-mentioned, and therefore it will be not further mentioned. Please refer to FIG. 6. FIG. 6 illustrates an internal architecture lateral diagram of the printer 80 according to a second embodiment of the present invention. The difference with the first embodiment is that the sensor module 82 of the printer 80 is installed at each side of the ribbon retrieving end 54. The sensor module 82 further comprises a moving rod 84, which can be a L-shaped moving rod, for carrying the first contact sensor 62 and the second contact sensor 64. The second contact sensor 64 is installed on the moving rod 84 which is close to the ribbon retrieving end 54. The ribbon retrieving end 54 comprises a shaft 86 wherein the utilized ribbon is retrieved to the shaft 86 of the ribbon retrieving end 54. A distance d' of an end of the first contact sensor 62 close to the ribbon retrieving end 54, and the distance d' of an end of the second contact sensor 64 close to the ribbon retrieving end 54 can be set by the designer. For example, if the distance d' can be set to be a distance from the outer layer of a ribbon on the shaft 86 of the ribbon retrieving end 54 contacting a group of unutilized ribbon dye area on the ribbon supply end 52 to the outer layer of the shaft 86 of the ribbon retrieving end 54, or the distance of other predetermined groups of ribbon dye area contacting the outer layer of the ribbon on the shaft 86 to the outer layer of the shaft 86 of the ribbon retrieving end 54.

Figure 7:
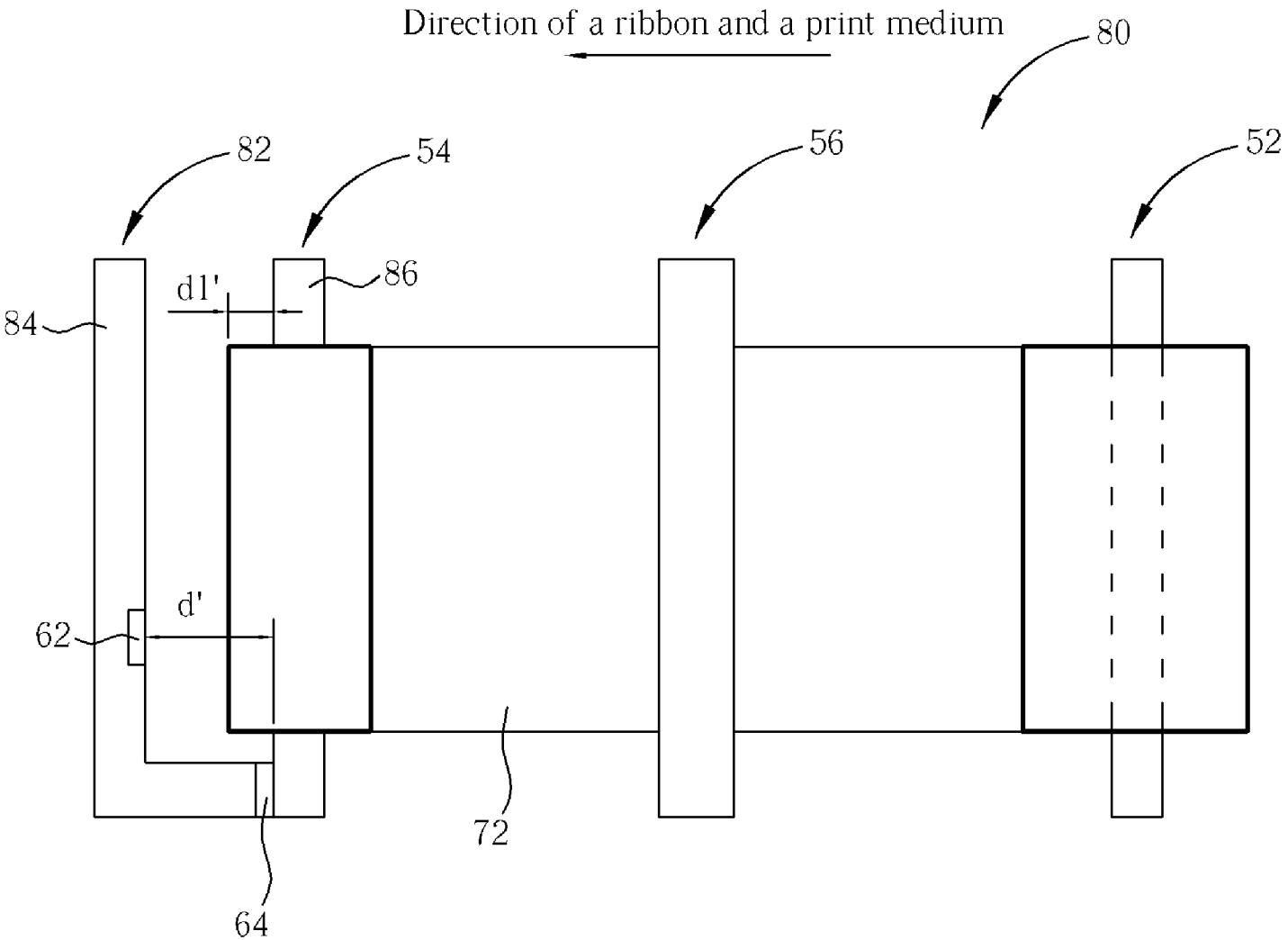
FIG. 7 illustrates an internal architecture top view diagram of a printer with sufficient ribbon according the second embodiment of the present invention.

Please refer to FIG. 7. FIG. 7 illustrates an internal architecture top view diagram of a printer 80 with sufficient ribbon according the second embodiment of the present invention. When executing each printout, before the print head 56 prints the dye on the ribbon 72 onto the print medium 74, the platen roller 70 and the print head 56 clamp onto the ribbon 72 and the print medium 74 together to prevent the ribbon 72 and the print medium 74 from slipping. Furthermore, the moving rod 84 of the sensor module 82 will carry the first contact sensor 62 and the second contact sensor 64 towards the ribbon retrieving end 54, when the second contact sensor 64 contacts the shaft 86 of the ribbon retrieving end 54, the sensor module 82 will transmit a corresponding signal to the control module 68 such that the control module 68 is notified when the second contact sensor 64 has contacted the shaft 86 on the ribbon retrieving end 54. If the printer 80 has sufficient ribbon to execute a printout, which means that a distance d1' from the utilized ribbon on the shaft 86 of the ribbon retrieving end 54 to the outer layer of the shaft 86 of the ribbon retrieving end 54 is lesser than d'. At the same time when the second contact sensor 64 contacts the shaft 86 on the ribbon retrieving end 54, as the distance d1' from the outer layer of the ribbon on the shaft 86 of the ribbon retrieving end 54 to the outer layer of the shaft 86 of the ribbon retrieving end 54 is lesser than a distance d' of an end of the first contact sensor 62 close to the ribbon retrieving end 54 and a distance d' of an end of the second contact sensor 64 close to the ribbon retrieving end 54. The first contact sensor 62 cannot contact the ribbon of the ribbon retrieving end 54 which means that the unutilized ribbon in the printer 80 is sufficient to perform a next printout. Furthermore, the control module 68 will control the moving rod 76 to move away from the ribbon retrieving end 54, and control the driving module 58 to drive the ribbon supply end 52 and the ribbon retrieving end 54 and to move the ribbon 72 from the ribbon supply 52 to the ribbon retrieving end 54. The control module 68 will control the print head 56 to print the dye on the ribbon onto the print medium 74, hence a printout is completed.

Figure 8:
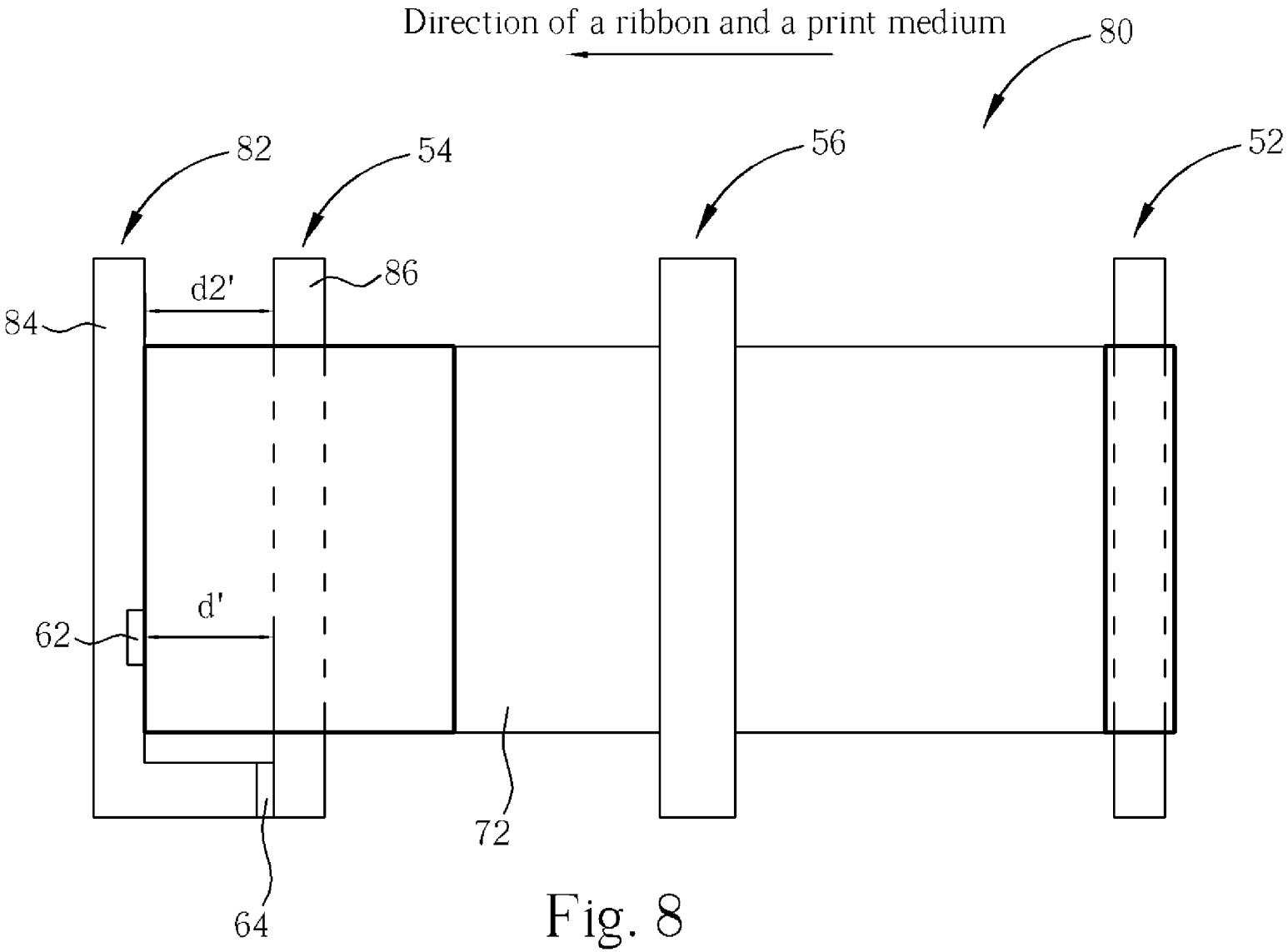
FIG. 8 illustrates an internal architecture top view diagram of a printer with insufficient ribbon according to the second embodiment of the present invention.

Please refer to FIG. 8. FIG. 8 illustrates an internal architecture top view diagram of a printer 80 with insufficient ribbon according to the second embodiment of the present invention. When the printer 80 cannot perform a next printout, it means that a distance d2' from the outer layer of the ribbon of the shaft 86 of the ribbon retrieving end 54 to the outer layer of the ribbon retrieving end 54 is greater than the distance d'. The printer 80 has insufficient unutilized ribbon for a next printout, which means that the printer 80 cannot execute a next printout. Before the print head 56 prints the dye on the ribbon 72 onto the print medium 74, the moving rod 84 of the sensor module 82 carries the first contact sensor 62 and the second contact sensor 64 towards the ribbon retrieving end 54. At the same time when the second contact sensor 64 contacts the shaft 86 of the ribbon retrieving end 54, as the distance d2' of the outer layer of the ribbon of the shaft 86 of the ribbon retrieving end 54 to the outer layer of the shaft 86 of the ribbon retrieving end 54 is greater than a distance d' of an end of the first contact sensor 62 close to the ribbon retrieving end 54 and a distance d' of an end of the second contact sensor 64 close to the ribbon retrieving end 54. The first contact sensor 62 will contact the ribbon on the ribbon retrieving end 54 which means that the unutilized ribbon in the printer 80 is insufficient to perform a next printout. The sensor module 82 will transmit a corresponding signal to the control module 68, and in receiving the corresponding signal the control module 68 will not control the driving module 58 to drive the ribbon supply end 52 and the ribbon retrieving end 54, and will not control the print head 56 to print the dye on the ribbon 72 onto the print medium 74, hence a print job is discontinued. Furthermore, after receiving the corresponding signal, the control module 68 is capable of controlling the warning interface 66 to display a warning signal to advice the user that there is insufficient ribbon to proceed with the next printout and to replace the existing ribbon. In this way, the printer 80 will not perform a next printout when there is insufficient ribbon therefore a printing error can be avoided In comparison with the prior art, the printer utilizes a contact sensor to detect unutilized ribbon and to advise the user to replace the ribbon because there is insufficient ribbon to proceed with the next printout. In this way, the printer will not perform a next printout when there is insufficient ribbon therefore a printing error can be avoided. The present invention overcomes the defect of the special barcode when the ribbon reaches a predetermined group number and has to stay within each dye area to be detected according to the prior art, hence the present invention increases the effective utilization of the ribbon, resulting in lower production costs of the ribbon.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A printer capable of detecting status of unutilized ribbon, the printer comprising:

a ribbon supply end comprising a shaft;

a ribbon retrieving end;

a ribbon wherein two ends are installed on the ribbon supply end and the ribbon retrieving end respectively;

a print head for printing dye on the ribbon onto a print medium;

a driving module for driving the ribbon supply end and the ribbon retrieving end, and to move the ribbon from the ribbon supply end to the ribbon retrieving end;

a sensor module installed at each side of the ribbon supply end comprising a first contact sensor, and a second contact sensor installed between the first contact sensor and the ribbon supply end; and a control module for controlling the printer when the first contact sensor contacts the ribbon on the ribbon supply end according to whether the second contact sensor contacts the shaft of the ribbon supply end.

2. The printer of claim 1 wherein the control module controls whether the print head prints the dye on the ribbon onto the print medium according to whether the second contact sensor contacts the shaft of the ribbon supply end.

3. The printer of claim 2 wherein the control module controls the print head not to print the dye on the ribbon onto the print medium when the second contact sensor contacts the shaft of the ribbon supply end.

4. The printer of claim 2 wherein the control module controls the print head to print the dye on the ribbon onto the print medium when the second contact sensor does not contact the shaft of the ribbon supply end.

5. The printer of claim 1 further comprising:

a warning interface, coupled to the control module, wherein the control module controls the warning interface to display a warning signal when the second contact sensor contacts the shaft of the ribbon supply end.

6. The printer of claim 5 wherein the warning interface is a warning light.

7. The printer of claim 1 wherein the sensor module further comprises:

a movable rod for carrying the first contact sensor and the second contact sensor.

8. The printer of claim 1 wherein the printer is a thermal printer.

9. A method of controlling a printer, the method comprising the following steps:

(a) providing a first contact sensor, and a second contact sensor installed between the first contact sensor and a ribbon supply end of the printer;

(b) controlling the first contact sensor and the second contact sensor to move towards the ribbon supply end before the printer prints dye on a ribbon onto a print medium; and (c) controlling the printer when the first contact sensor contacts the ribbon on the ribbon supply end according to whether the second contact sensor contacts a shaft of the ribbon supply end.

10. The method of claim 9 wherein step (c) comprises controlling whether the printer prints the dye on the ribbon onto the print medium according to whether the second contact sensor contacts the shaft of the ribbon supply end.

11. The method of claim 10 wherein step (c) controls the printer not to print the dye on the ribbon on the print medium when the second contact sensor contacts the shaft of the ribbon supply.

12. The method of claim 10 wherein step (c) controls the printer to print the dye on the ribbon onto the print medium when the second contact sensor does not contact the shaft of the ribbon supply end and the first contact sensor is moved away from the ribbon on the ribbon supply end.

13. The method of claim 9 wherein step (c) comprises controlling the printer to display a warning signal when the second contact sensor contacts the shaft of the ribbon supply end.

14. A printer capable of detecting status of unutilized ribbon, the printer comprising:

a ribbon supply end;

a ribbon retrieving end comprising a shaft;

a ribbon wherein two ends are installed on the ribbon supply end and the ribbon retrieving end respectively;

a print head for printing dye on the ribbon onto a print medium;

a driving module for driving the ribbon supply end and the ribbon retrieving end, and to move the ribbon from the ribbon supply end to the ribbon retrieving end;

a sensor module, installed at each side of the ribbon retrieving end, comprising a first contact sensor, and a second contact sensor installed between the first contact sensor and the ribbon retrieving end; and a control module for controlling the printer when the second contact sensor contacts the ribbon on the ribbon retrieving end according to whether the first contact sensor contacts the shaft of the ribbon retrieving end.

15. The printer of claim 14 wherein the control module controls whether the print head prints the dye on the ribbon onto the print medium according to whether the first contact sensor contacts the ribbon on the ribbon retrieving end.

16. The printer of claim 15 wherein the control module controls the print head not to print the dye on the ribbon onto the print medium when the first contact sensor contacts the ribbon on the ribbon retrieving end.

17. The printer of claim 15 wherein the control module controls the print head to print the dye on the ribbon onto the print medium when the first contact sensor does not contact the ribbon on the ribbon retrieving end.

18. The printer of claim 14 further comprising:

a warning interface, coupled to the control module, wherein the control module controls the warning interface to display a warning signal when the first contact sensor contacts the shaft of the ribbon retrieving end.

19. The printer of claim 18 wherein the warning interface is a warning light.

20. The printer of claim 14 wherein the sensor module further comprises:

a movable rod for carrying the first contact sensor and the second contact sensor.

21. The printer of claim 14 wherein the printer is a thermal printer.

22. A method of controlling a printer, the method comprising the following steps:

(a) providing a first contact sensor, and a second contact sensor installed between the first contact sensor and a ribbon retrieving end of the printer;

(b) controlling the first contact sensor and the second contact sensor to move towards the ribbon retrieving end before the printer prints dye on a ribbon onto a print medium; and;

(c) controlling the printer when the second contact sensor contacts the shaft of the ribbon retrieving end according to whether the first contact sensor contacts the ribbon on the ribbon retrieving end.

23. The method of claim 22 wherein step (c) comprises controlling whether the printer prints the dye on the ribbon onto the print medium according to whether the first contact sensor contacts the ribbon on the ribbon retrieving end.

24. The method of claim 23 wherein step (c) controls the printer not to print the dye on the ribbon onto the print medium when the first contact sensor contacts the ribbon on the ribbon retrieving end.

25. The method of claim 23 wherein step (c) controls the printer to print the dye on the ribbon onto the print medium when the first contact sensor does not contact the ribbon on the ribbon retrieving end and the second contact sensor is moved away from the shaft of the ribbon retrieving end.

26. The method of claim 22 wherein step (c) comprises controlling the printer to display a warning signal when the first contact sensor contacts the ribbon on the ribbon retrieving end.

* * * * *